US005242164A

United States Patent [19]

Nicoll

[11] Patent Number: 5,242,164

[45] Date of Patent: Sep. 7, 1993

[54] TABLETOP HOCKEY OR SOCCER GAME

[76] Inventor: James D. Nicoll, 829 Randall, Troy, Mich. 48098

[21] Appl. No.: 897,844

[22] Filed: Jun. 12, 1992

[51] Int. Cl.[5] ..... A63F 7/06

[52] U.S. Cl. ..... 273/85 R; 273/85 F; 273/129 R; 273/119 R; 273/126 R; 273/129 W

[58] Field of Search ..... 273/129 R, 129 K, 129 L, 273/129 M, 129 P, 129 W, 119 R, 126 R, 85 R, 85 A, 85 B, 85 F, 87.2, 87.4, 67 B, 148 R, 90, 166, 175; D21/210, 213, 221, 48

[56] References Cited

U.S. PATENT DOCUMENTS

| | | | |
|---|---|---|---|
| 247,127 | 1/1978 | Kavka . | |
| 294,720 | 3/1988 | MacDowell . | |
| 648,336 | 4/1900 | Bellamy | 273/87.2 |
| 1,763,205 | 6/1930 | Winbigler | 273/87.2 |
| 1,846,412 | 2/1932 | Weinberg | 273/129 W |
| 3,574,350 | 4/1971 | May | 273/85 |
| 3,647,212 | 3/1972 | Barlow | 273/85 B |
| 3,679,209 | 7/1972 | Wexstaff | 273/129 K |
| 3,785,648 | 1/1974 | Kobayashi | 273/85 B |
| 3,801,100 | 4/1974 | Lebrun | 273/85 F |
| 3,912,269 | 10/1975 | Barlow | 273/85 B |
| 3,940,135 | 2/1976 | Cohen | 273/85 F |
| 3,944,223 | 3/1976 | Bromwell . | |
| 3,970,306 | 7/1976 | Smith, Jr. | 273/85 F |
| 4,007,932 | 2/1977 | LeBrun | 273/85 F |
| 4,012,040 | 3/1977 | Fernandes | 273/85 A |
| 4,014,543 | 3/1977 | Arad | 273/85 H |
| 4,018,443 | 4/1977 | Bird | 273/85 R |
| 4,063,728 | 12/1977 | Zemanek . | |
| 4,105,210 | 8/1978 | Jones et al. | 273/126 R |
| 4,165,076 | 8/1979 | Cella | 273/129 K X |
| 4,166,620 | 9/1979 | Sheppard | 273/126 R |
| 4,256,306 | 3/1981 | Gross et al. | 273/85 R |
| 4,261,568 | 4/1981 | Such | 273/85 R |
| 4,274,635 | 6/1981 | Pakogian | 273/85 R |
| 4,290,606 | 9/1981 | Maxwell | 273/129 K X |
| 4,300,766 | 11/1981 | Haynes | 273/85 R |
| 4,311,309 | 1/1982 | Bradley et al. | 273/85 B |
| 4,382,600 | 5/1983 | Vieira | 273/129 K X |
| 4,474,375 | 10/1984 | Stockdale | 273/85 B |
| 4,691,920 | 9/1987 | Murphy et al. | 273/85 A |
| 4,765,622 | 8/1988 | Rienzo | 273/85 R |
| 4,936,582 | 6/1990 | Bernstein | 273/81 R X |
| 5,016,878 | 5/1991 | Hay et al. | 273/85 F |
| 5,029,862 | 7/1991 | Driska | 273/119 R |
| 5,074,556 | 12/1991 | Loeppky et al. | 273/85 R |
| 5,116,057 | 5/1992 | Mangiaragina | 273/166 X |

FOREIGN PATENT DOCUMENTS

| | | | |
|---|---|---|---|
| 648654 | 9/1962 | Canada | 273/129 W |
| 811329 | 8/1951 | Fed. Rep. of Germany | 273/85 F |
| 28855 | 6/1964 | German Democratic Rep. | 273/67 B |
| 625448 | 9/1961 | Italy | 273/85 R |
| 717690 | 10/1966 | Italy | 273/85 R |
| 616782 | 1/1949 | United Kingdom | 273/85 R |
| 731994 | 6/1955 | United Kingdom | 273/85 R |

*Primary Examiner*—Vincent Millin
*Assistant Examiner*—Sebastiano Passaniti
*Attorney, Agent, or Firm*—Krass & Young

[57] ABSTRACT

A tabletop hockey game includes a scoring member configured for affixation to a player's hand. The scoring member includes a transversely curved shooting portion which enables the player to lift the puck above the playing surface for top shelf scoring.

14 Claims, 2 Drawing Sheets

TABLETOP HOCKEY OR SOCCER GAME

FIELD OF THE INVENTION

This invention relates generally to games. More specifically, the invention relates to tabletop games which simulate hockey, soccer or similar sports. Most specifically, the invention relates to tabletop games which include a manually operated, particularly configured member for a projecting a puck, ball or the like into a goal.

BACKGROUND OF THE INVENTION

There exist a wide variety of tabletop action games which simulate sports such as hockey, soccer and the like. In games of this type, a player attempts to score points by shooting a puck or ball into an opponent's goal while at the same time defending his own goal. U.S. Pat. No. 3,785,648 shows a tabletop hockey game wherein each player controls a number of player pieces which operate to either drive a puck across a simulated playing surface or to defend a goal. A similar game is shown in U.S. Pat. No. 4,765,622 wherein players manipulate miniature hockey sticks on a playing surface which simulates a miniature hockey rink. U.S. Pat. No. 5,074,556 also shows a similar game wherein miniature sticks and rinks are used. U.S. Pat. No. 4,261,568 discloses a soccer-like game wherein players are provided with hand-held propelling devices for driving a disk across a playing surface. U.S. Pat. No. 4,166,620 discloses a game simulative of hockey wherein players flick a disk with their fingers in an attempt to score goals.

One general shortcoming of prior art games of this type is that they are essentially two-dimensional in play; that is, prior art games have not provided players with the ability to loft the projectile above the playing surface. In reality, much of the play near the goals in hockey and soccer involves maneuvering a puck or ball above the playing surface to evade the goal tender's actions.

Another problem with prior art tabletop action games is that they frequently involve extensive and complicated mechanisms for moving the player pieces or otherwise controlling shooting. Such mechanisms tend to slow up the game and to make the equipment cumbersome and costly. The present invention recognizes that the appeal of tabletop action games would be greatly enhanced if players had the ability to lift the ball or puck from the playing surface and to accurately and rapidly shoot it toward the goal in a manner which could evade the goal tender. The present invention also recognizes the need to simplify prior art game systems to thereby increase their speed and decrease their costs. As will be apparent from the drawings, discussion and description which follow, the present invention provides an improved tabletop action game of the hockey or soccer type. These and other advantages of the present invention will be readily apparent from the drawings, discussion and description which follow.

BRIEF DESCRIPTION OF THE INVENTION

There is disclosed herein a game which comprises a game board having a generally planar, rectangular, playing surface. The game board has a goal disposed at the first end of the playing surface and the game further includes a projectile dimensioned to pass into the goal. The game further comprises a scoring member for propelling the projectile across the playing surface. The scoring member includes a relatively planar attachment portion engageable by a player's hand. The scoring member also has a shooting portion which is formed of a resilient material and which is contiguous with a linear, bottom edge of the scoring member. The shooting portion is curved along an axis which is parallel to the bottom edge.

In particular embodiments, the game includes a second goal at an end of the playing surface opposite the first goal. The playing surface is preferably made from a material having a low coefficient of friction and may be marked to simulate a hockey rink or soccer field. Depending on the particular game played, the projectile may be a puck or a ball and the scoring member may be shaped and marked to simulate an appropriate player.

In particular embodiments, the shooting member comprises a unitary member formed from a sheet of resilient, polymeric material. The attachment portion of the shooting member may also include means for affixing the shooting member to the hand and such means may include a band of elastomeric material. The game may also include one or more defensive members also engageable by a hand of a player. The defensive members are configured to cover a portion of the goal and are used to block entry of the projectile.

DETAILED DESCRIPTION OF THE INVENTION

The present invention comprises a tabletop game which may be used to play simulated versions of a large number of action games of the type wherein a player attempts to score by driving a projectile into a goal. The invention will be described primarily with reference to a hockey or soccer type of game; although, it is to be understood that a variety of other games may be played with the herein described apparatus.

Figure 1:
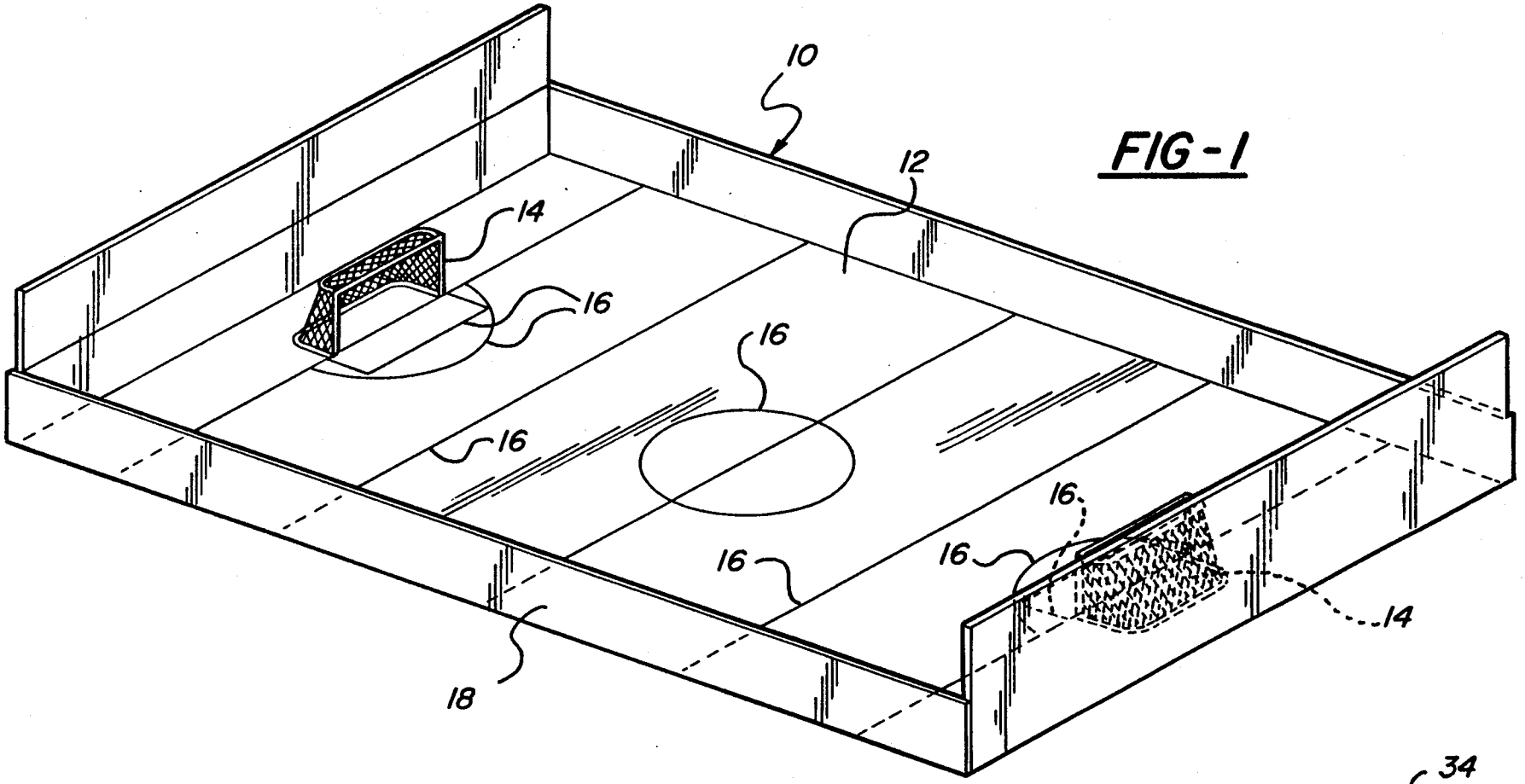
FIG. 1 is a perspective view of one embodiment of a game board structured in accord with the present invention.

Referring now to FIG. 1, there is shown a perspective view of a game board 10 structured in accord with the present invention. The board 10 includes a generally planar, rectangular playing surface as well as a pair of goals 14 at opposite ends thereof. It will be noted that the playing surface 12, in this embodiment, is marked with indicia simulating a hockey rink. It will also be noted that the game board includes a barrier wall 18 surrounding the playing surface 12. It is generally preferred that the playing surface 12 be fabricated from a material having a low coefficient of friction and toward that end may include a coating of a polymeric material such as a fluoropolymer or it may include a coating of a hydrocarbon polymer such as polyethylene or polypropylene. In some instances the playing surface may be waxed. One particularly preferred material comprises hard board coated with enamel paint and/or one of the aforementioned polymers.

In the play of the game, the players will attempt to drive a ball, puck or similar projectile into an opponent's goal while protecting their own goal. Therefore, the game will also include a scoring member as well as a defensive member.

Figure 3:
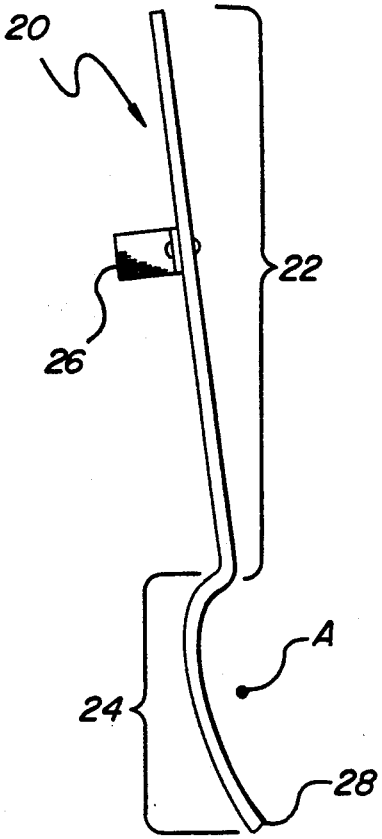
FIG. 3 is a side elevational view of the scoring member of FIG. 2.
Figure 4:
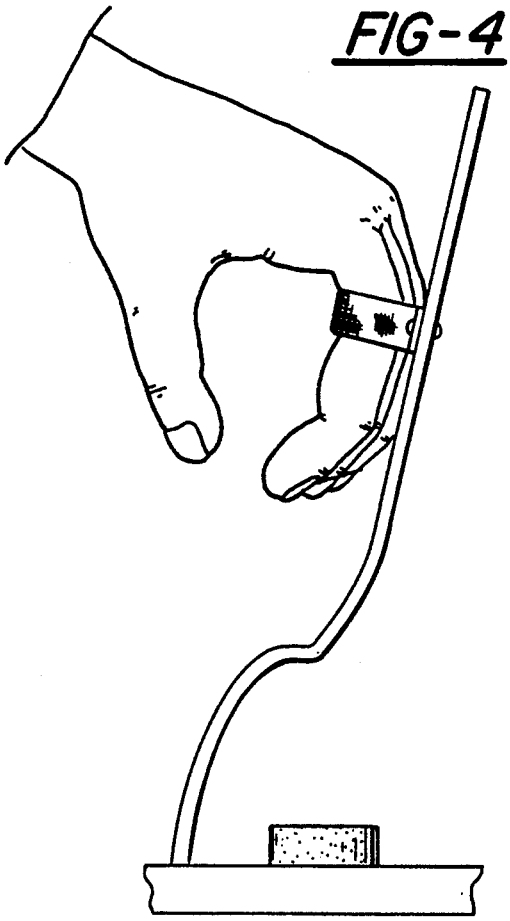
FIG. 4 is a side elevational view of the scoring member of FIG. 3 shown attached to a player's hand and disposed to propel a puck across a game board.
Figure 2:
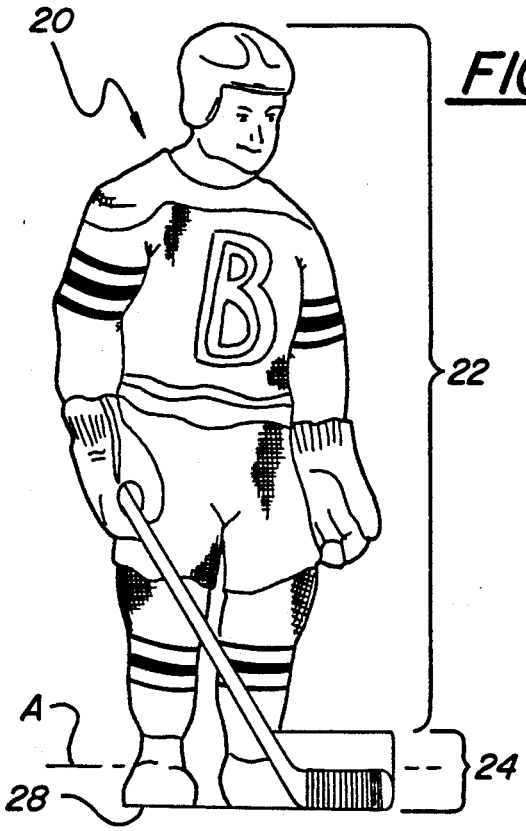
FIG. 2 is a front elevational view of a scoring member structured in accord with the principles of the present invention.

Referring now to FIGS. 2–4, there is shown a series of illustrations depicting one embodiment of scoring member. FIG. 2 shows a front elevational view of a scoring member 20 structured in accord with the present invention and configured to simulate a hockey player. The scoring member 20 is shown in a side elevational view in FIG. 3 and it will be seen that it includes a generally planar attachment portion 22 and a curved shooting portion 24. The shooting portion is fabricated from a resilient material; and, within the context of this disclosure, a resilient material is one which may be bent or deformed to some degree by an applied force and which returns to its original shape when the force is removed. Resilient materials include, by way of illustration, some metals such as spring steel, rubber, synthetic polymers and composites.

The attachment portion 22 is configured to engage a player's hand and the illustrated embodiment includes a band 26 affixed thereto. The band 26 may comprise an elastomeric band fabricated from elastic, rubber or the like or it may comprise an adjustable band including a fastener such as a buckle or a body of separable hook and loop fastener material. In the simplest embodiment, the attachment band 26 comprises a rubber band which is looped around the scoring member 20 and around the user's hand.

It will be noted from the figures and particularly with regard to FIG. 2, the scoring member includes a generally linear bottom edge 28, and the shooting portion 24 of the scoring member 20 is contiguous with this linear bottom edge 28. It will also be seen, with particular regard to FIG. 3, that the shooting portion 24 of the scoring member 20 is curved in a direction transverse to the length of the scoring member 20. The curvature is along an axis A which is generally parallel to the linear edge 28. The axis A is indicated by a dotted line in FIG. 2. It should be noted that the curvature of the shooting portion 24 may be of circular cross section or it may be elliptical, parabolic, hyperbolic or some combination or intermediate form of the foregoing curvatures. In some embodiments, the curve may be of V-shaped cross section in keeping with the spirit of the present invention.

It is a notable feature of the present invention that the particular configuration of scoring member allows for the puck or other such projectile to be lifted from the playing surface. In hockey parlance "top shelf" means lifting the puck up and shooting it into the goal just under the crossbar and a highly skilled player can use this technique to evade the actions of a goalie. In heretofore available tabletop hockey games, the ability to accurately loft the puck above the playing surface was lacking.

Referring now to FIG. 4, there is shown a side view of the scoring member 20 as shown in use. The scoring member is affixed to the hand 30 of a player by means of an elastic strap 26. The bottom edge 28 of the scoring member 20 is in contact with the surface 12 of the game board. A puck 32 is disposed in close proximity to the edge 28 of the scoring member 20. In the illustration, the player is biasing the scoring member 20 in the direction of the playing surface 12 and as such is compressing and flexing the shooting portion 24 of the scoring member 20. The shooting portion 24 is resilient and bends so as to store energy therein. When the player raises the scoring member 20 away from the playing surface 12, the shooting portion 24 springs forward propelling the puck 32 and because of the particular curvature thereof, lifts the puck 32 from the playing surface 12. By controlling the angle at which the scoring member is biased toward the playing surface 12 and by controlling the side-to-side orientation of the scoring member 20 with respect to the playing surface 12 and by regulating the force with which the scoring member 20 is biased to the playing surface 12, the player may accurately control the path of travel of the puck so as to precisely place it into the opening in the goal.

As illustrated in FIG. 4, the scoring member 20 comprises a unitary body defining both the attachment 22 and shooting 24 portions. In this embodiment, the scoring member is fabricated from a resilient material such as spring steel or a resilient polymer. One particularly preferred material comprises medium density polyethylene of approximately 1–2 millimeters in thickness.

Clearly, other variations of scoring member are possible within the scope of the present invention. For example, the scoring member may be fabricated as two-part member wherein the attachment portion 22 and shooting portion 24 are separate bodies of material which are joined together. For example, the shooting portion 22 may comprise a relatively rigid body of fiberboard, wood, metal or plastic with a relatively thinner, more flexible shooting portion 24 affixed thereto. Also, while the attachment portion 22 is shown as joined to a player's hand 30 by an attachment strap 26, other variations are also possible within the scope of the invention. For example, the attachment portion 22 may be configured to be grasped by the player in the manner of a handle. Alternatively, it may include a glove-like portion for receiving the user's hand.

Figure 5B:
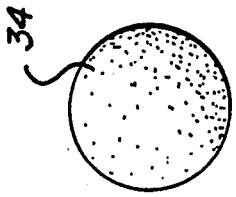
FIG. 5B is a ball which may be used in the game.
Figure 5A:
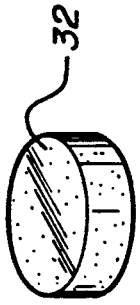
FIG. 5A is a puck which may be used in the present game.

The principles of the present invention may be extended to a variety of games including soccer, hockey, football, baseball and basketball. The nature of the projectile used in the game will depend upon the particular game and the degree of action desired. FIG. 5A depicts a puck which may be used for hockey games. FIGS. 5B depicts a ball 34 which may be used for soccer and similar games.

Figure 6:
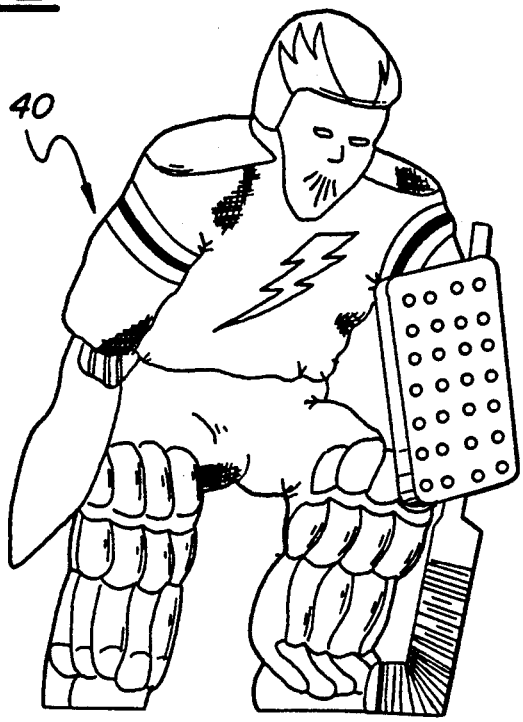
FIG. 6 is a front elevational view of a defensive member for use in the game of the present invention.

In most instances it will be desirable to include a defensive member in the game of the present invention. FIG. 6 depicts a front view of a defensive player 40 configured to resemble a hockey goalie. This member is also preferably configured to be attached to a player's hand. In some instances it may be desirable to include a curved shooting portion at the base of the defensive player; although, in other instances the defensive player 40 will be generally planar throughout. It should be noted that configurations of defensive players other than that depicted herein may be employed. It is generally desirable that the defensive player be configured so as to protect a portion, but not all of the opening of the goal.

In a typical game, a player affixes a shooting member to one hand and a defensive member to the other. A second player is similarly equipped and the puck or ball is placed on the playing surface. The players then attempt to shoot the puck into an opponent's goal while blocking shots into their own goal. As in the conventional game, play proceed for a predetermined time or until a selected score is obtained. The game of the present invention may be played in many configurations; and, variations in the configuration of the game board and the scoring and defensive members will be readily apparent to one of skill in the art, from the disclosure contained herein. In view of the foregoing, it is to be understood that the drawings, discussion and description presented herein are merely meant to illustrate particular embodiments of the present invention and not meant to be limitations upon the practice thereof. It is the following claims including all equivalents which define the scope of the invention.

I claim:

1. A game comprising:

a game board including a generally planar, rectangular playing surface;

a first goal disposed at a first end of said playing surface;

a projectile dimensioned to pass into said goal; and a scoring member for propelling said projectile across the playing surface, said scoring member having a relatively planar attachment portion engageable by a hand of a player, said attachment portion including a body of elastomeric material for affixing the scoring member to the hand of the player, said scoring member also having a shooting portion which is formed of a resilient material and which is contiguous with a linear, bottom edge of said scoring member; said shooting portion being curved along an axis which is parallel to said bottom edge.

2. A game as in claim 1, wherein said playing surface is fabricated from a material having a low coefficient of friction.

3. A game as in claim 1, wherein said playing surface includes indicia thereupon simulative of a hockey rink.

4. A game as in claim 1, wherein said playing surface includes indicia thereupon simulative of a soccer field.

5. A game as in claim 1, wherein said projectile is a disk simulative of a hockey puck.

6. A game as in claim 1, wherein said projectile is a sphere simulative of a soccer ball.

7. A game as in claim 1, wherein said scoring member is a polygonal shape simulative of a hockey player.

8. A game as in claim 1, wherein said scoring member is comprised of a unitary body of resilient material.

9. A game as in claim 1, further including a defensive member engageable by a hand of a player, said defensive member configured to cover a portion of the opening of the goal so as to impede entry of the projectile thereinto.

10. A game as in claim 1, further including a second goal, generally similar to the first goal, said second goal being disposed at a second end of the playing surface.

11. A scoring member for use in an action board game, said scoring member being of a generally polygonal shape and including indicia thereupon simulative of a hockey player, said scoring member having a linear bottom edge configured to engage a surface of a playing board, said scoring member including a relatively planar attachment portion engageable by a hand of a player and further including a shooting portion which is formed of a resilient material and which is contiguous with said linear bottom edge, said shooting portion being curved along an axis which is parallel to said bottom edge; said scoring member being operable to store energy in said shooting portion when the bottom edge is engaged with the playing surface and the scoring member is biased toward said surface, and to release said stored energy when the scoring member is subsequently biased away from said playing surface; whereby, said released energy may be transferred to a projectile which is in contact with said shooting portion.

12. A scoring member as in claim 11, comprising a unitary body of polymeric material.

13. A scoring member as in claim 11, wherein said attachment portion includes means for affixing the scoring member to the hand of said player.

14. A scoring member as in claim 13, wherein said attachment member includes a body of elastomeric material.

* * * * *